US009093749B2

(12) United States Patent
Tsai et al.

(10) Patent No.: US 9,093,749 B2
(45) Date of Patent: Jul. 28, 2015

(54) FLUIDIC DIPOLE ANTENNA

(75) Inventors: Wen-Kai Tsai, New Taipei (TW); Hsin-Kuo Dai, New Taipei (TW); Yu-Min Wang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 426 days.

(21) Appl. No.: 13/554,171

(22) Filed: Jul. 20, 2012

(65) Prior Publication Data

US 2013/0021217 A1 Jan. 24, 2013

(30) Foreign Application Priority Data

Jul. 20, 2011 (TW) ..... 100125564 A

(51) Int. Cl.

| | |
|---|---|
| ***H01Q 9/16*** | (2006.01) |
| ***H01Q 9/28*** | (2006.01) |
| ***H01Q 1/24*** | (2006.01) |
| ***H01Q 1/36*** | (2006.01) |

(52) U.S. Cl.

CPC ..... *H01Q 9/28* (2013.01); *H01Q 1/245* (2013.01); *H01Q 1/364* (2013.01)

(58) Field of Classification Search

CPC ..... H01Q 1/245; H01Q 1/364; H01Q 9/28
See application file for complete search history.

(56) References Cited

U.S. PATENT DOCUMENTS

| | | | | |
|---|---|---|---|---|
| 7,477,123 | B2 | 1/2009 | Beerling | |
| 2002/0093460 | A1 * | 7/2002 | Alexeff et al. | 343/901 |
| 2003/0189526 | A1 * | 10/2003 | Gustafson | 343/793 |
| 2004/0252069 | A1 * | 12/2004 | Rawnick et al. | 343/789 |
| 2007/0132656 | A1 * | 6/2007 | Kim et al. | 343/895 |
| 2012/0007778 | A1 | 1/2012 | Duwel | |
| 2012/0075069 | A1 | 3/2012 | Dickey et al. | |
| 2014/0137657 | A1 * | 5/2014 | Dickey et al. | 73/763 |

FOREIGN PATENT DOCUMENTS

| | | |
|---|---|---|
| CN | 2612087 Y | 4/2004 |
| TW | 200616282 | 5/2006 |
| TW | M386609 | 8/2010 |

* cited by examiner

*Primary Examiner* — Trinh Dinh
(74) *Attorney, Agent, or Firm* — Ming Chieh Chang; Wei Te Chung

(57) ABSTRACT

An antenna comprises: a closed and insulating receiving housing; a radiating portion received in the receiving housing and including a liquid metal; a grounding portion received in the receiving housing and including a liquid metal; a pair of wires respectively connected to the radiating portion and the grounding portion and extending out of the receiving housing; and two air chambers respectively located on the ends of the radiating portion and the grounding portion.

19 Claims, 3 Drawing Sheets

FLUIDIC DIPOLE ANTENNA

BACKGROUND OF THE INVENTION

1. Field of the Invention

The present invention relates to a fluidic antenna, and more particularly to a fluidic antenna used in an mobile phone to reduce harmful effect to a user.

2. Description of Related Arts

It is known to use microelectromechanical systems (MEMS) device design and fabrication techniques in forming liquid metal inductors. as well as microswitch and other circuit components. Various liquid metal circuit component architectures have been implemented, and differences among the architectures include: mechanisms for actuating the circuit component (e.g., moving the liquid metal), devices and techniques for loading the circuit components with liquid metal, and fabrication techniques. Liquid metal inductor is formed from two separate material layers, e.g., separate wafers or portions thereof that have been bonded together. The inductor is formed by filling a generally spiral shaped channel or cavity with a liquid metal or other sufficiently electrically conductive liquid. Numerous different techniques can be used to produce the proper amount of liquid metal in the inductor channel. See, for example, U.S. Pat. No. 7,477,123.

U.S. Patent Application Publication No. 2012/0075069 discloses a fluidic structure behaving as an antenna and a method of its manufacturing. The reversibly deformable and mechanically tunable fluidic antenna may be formed by injecting a liquid metal, such as gallium (Ga) or gallium-based alloy, into one or more cavities within a material substrate or a base material coupled to a bonding layer material. Because the antenna is formed with a liquid metal, the mechanical properties of the antenna may be defined by mechanical properties of the substrate. As such, for an elastomeric substrate, the resulting elastomeric fluidic antenna may be deformed (e.g., stretched, bent, flexed, rolled, etc.) and released/reversed without loss of electrical continuity. The base material may be formed of any elastomeric or rigid material, such as a low dielectric constant low-loss tangent elastomer. Silicones represent a category of elastomers.

U.S. Patent Application Publication No. 2012/0007778 discloses use of microfluidic technology, utilizing conductive liquid and/or floated conductive solids, to form a variety of reconfigurable and/or steerable electronic components such as antennas. For example, a dipole antenna includes a conducting surface (in the form of two arms) disposed on a layer. The frequency of the antenna may be tuned by positioning conductors within microfluidic channels to effectively increase the length of the antenna arms. Each conductor may be disposed within a dedicated microfluidic channel, or a single microfluidic channel may contain all of the conductors. The conductors may be repositioned within microfluidic channels via a suitably disposed actuating mechanism. In another exemplary arrangement, an antenna emits a beam of radiation that may be steered to any of four positions. Such antenna arrangement includes or consists essentially of a driven element that is a fluidic or floating solid conductor disposed within a microfluidic channel, as well as a reflector and a director (i.e., parasitic elements) that may be printed directly on the substrate of antenna. Driven element may then be moved within microfluidic channel between the parasitic elements in order to steer beam through any number of preset positions. In another embodiment, the design reconfigures the physical radiating structure in order to steer the antenna beam. Thus, parasitic elements are optional and a single radiating structure may be used (helpful in applications where small size is desired). It may also enable the reconfiguring of miniature antennas in response to environmental changes.

Example antenna designs that fluidic antennas may be formed as include a single element (e.g., single pole) antenna, a dipole antenna, a helix antenna, a coil antenna, a patch antenna, etc. A dipole antenna may generate strong electromagnetic wave radiating when it is working. The radiation may be harmful to human body. In particular, when a mobile phone user answers a phone call, the phone is brought closer to the ear of the user.

An improved antenna to existing technology is desired.

SUMMARY OF THE INVENTION

An object of the present invention is to provide an antenna, of which a radiating portion can be moved for decreasing harm to a user using an electronic equipment having the antenna.

To achieve the above-mentioned object, an antenna comprises a closed and insulating receiving housing; a radiating portion received in the receiving housing and including a liquid metal with radiation function; a grounding portion received in the receiving housing and including a liquid metal with grounding function; a pair of wires respectively connected to the radiating portion and the grounding portion and extending out of the receiving housing; and two air chambers respectively located on the ends of the radiating portion and the grounding portion.

Other objects, features and advantages of the invention will be apparent from the following detailed description taken in connection with the accompanying drawings.

DETAILED DESCRIPTION OF THE PREFERRED EMBODIMENT

Reference will now be made in detail to preferred embodiments of the present invention.

Figure 1:
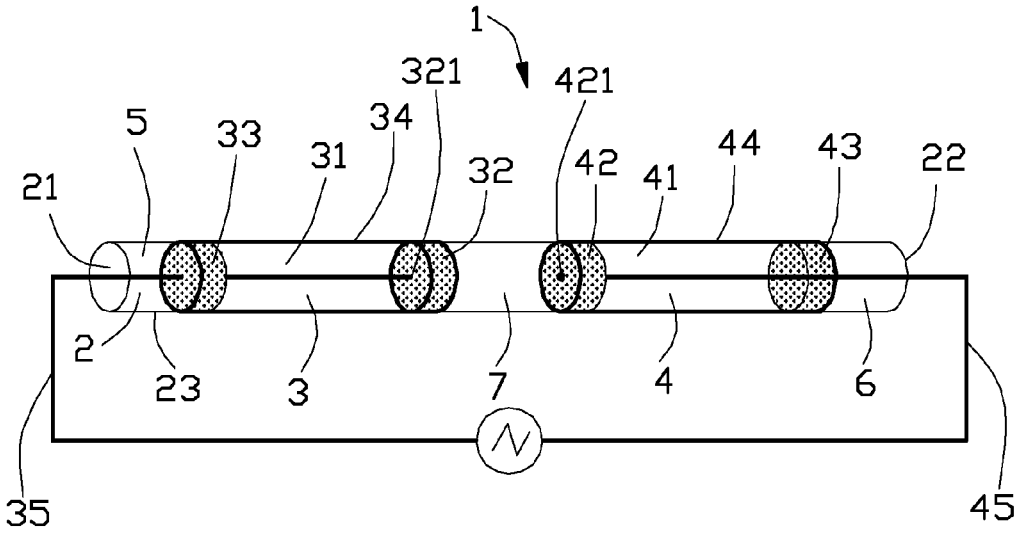
FIG. 1 is a perspective view of an antenna in accordance with a first embodiment of the present invention.
Figure 2:
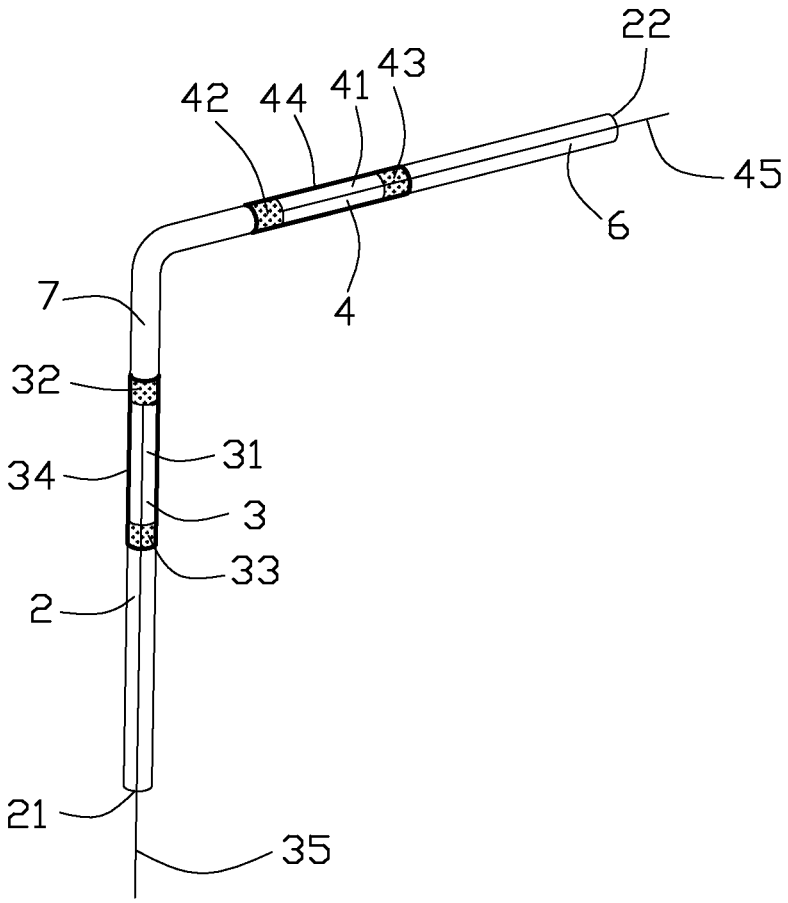
FIG. 2 is a perspective view of an antenna in accordance with a second embodiment of the present invention.
Figure 3:
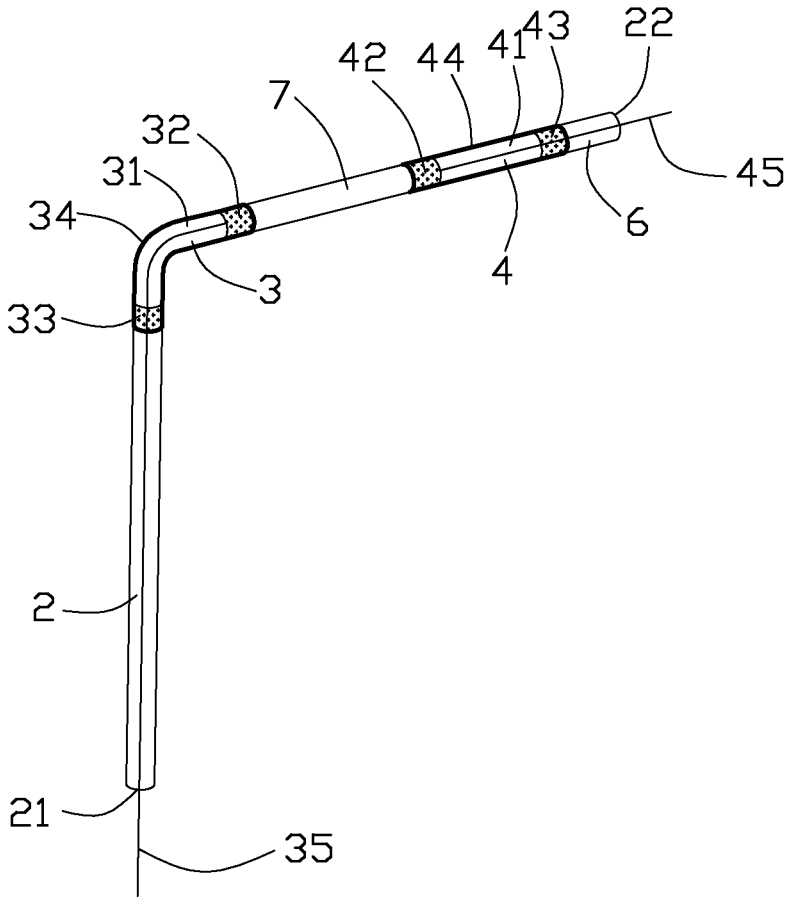
FIG. 3 is another perspective view of the antenna in FIG. 2, of which a radiation portion and a grounding portion thereof are moved.

Referring to FIG. 1, an antenna 1 for being disposed in a mobile phone in accordance with a first embodiment of the present invention comprises a receiving housing 2 which is closed. The receiving housing 2 is made of insulating material, such as glass, plastic, etc. In this embodiment, the receiving housing 2 is cylinder-shaped, though it may be of other regular shapes, such as a cuboid. An inner surface of the receiving housing 2 has first and second end surfaces 21, 22 and a connecting surface 23 therebetween. The connecting surface 23 is of a smooth surface. The end surfaces 21, 22 are parallel to each other and the connecting surface 23 extends along a straight line. Referring to FIGS. 2 to 3, in accordance with a second embodiment of the present invention, the end surfaces 21, 22 are positioned at an angle with respect to each other, and the connecting surface 23 extends with a bend.

Referring to FIG. 1 again, the antenna 1 defines a radiating portion 3 and a grounding portion 4 in the receiving housing 2. The structure of the radiating portion 3 is same as the structure of the grounding portion 4. Each of the radiating portion 3 and the grounding portion 4 has a liquid metal 31 or 41 having a certain length, a first piston 32 or 42 located at an end of the liquid metal 31 or 41, a second piston 33 or 43 located at the other end of the liquid metal 31 or 41, and an insulative portion 34 or 44. At least one of the first piston 32 or 42 and the second piston 33 or 43 is made of metal material, and the other can be made of plastic material or metal material.

The insulative portion 34 or 44 is made of a little softer material, such as plastic or glass material. The insulative portion 34 or 44 encloses the liquid metal 31 or 41, the first piston 32 or 42, and the second piston 33 or 43. An outer surface of the insulative portion 34 or 44 is smooth and contacts with the connecting surface 23 of the receiving housing 2. Between the insulative portion 34 or 44 and the connecting surface 23 there is very small friction.

The liquid metal 31 or 41 can be made of Mercury or Gallium Indium Alloy which are liquid at room temperature. The radiating portion 3 connects to a wire 35, and the grounding portion 4 also connects to the other wire 45. A feeder point 321 of the antenna 1 is formed at a connecting point between the first piston 32 and the wire 35 penetrating through the liquid metal 31. A grounding point 421 of the antenna 1 is formed at another connecting point between the first piston 42 and the wire 45 penetrating through the liquid metal 41. The grounding portion 4 is symmetrical with the radiating portion 3. Understandably, if the second piston 33 or 43 is made of metal material, the feeder point and the grounding point are formed, respectively, at a connecting point between the wire 35 and the second piston 33 and at a connecting point between the wire 45 and the second piston 43.

A first air chamber 5 is formed between the end surface 21 of the receiving housing 2 and the radiating portion 3, and a second air chamber 6 is formed between the end surface 22 of the receiving housing 2 and the grounding portion 4. A third air chamber 7 is formed between the radiating portion 3 and the grounding portion 4. The three air chambers 5, 6, 7 are full of air. The air chambers 5, 6, 7 are not in fluid communication with one another.

According to application, the radiation frequency band of the antenna 1 is determined by appropriately arranging the length of the liquid metal 31 or 41 as supported by experimental data.

When the antenna is in use, due to environmental changes, it is subject to temperature change in the first air chamber 5 (or the second air chamber 6), thereby squeezing the second air chamber 6 (or the first air chamber 5) because of pressure change in the air chambers to push the radiating portion 3 or the grounding portion 4. The radiating portion 3 and the grounding portion 4 can maintain a balance when the radiating portion 3 and the grounding portion 4 are arrived at a point, respectively. After moving the radiating portion 3 and the grounding portion 4, the distribution of the radiating pattern of the antenna is changed. To a certain extent, the antenna can avoid dead zones which otherwise exists in unmoved antenna. Due to the phenomenon that human body temperature is higher than the mobile phone antenna temperature, when the antenna 1 is used in the mobile phone, and a person touches one end of the antenna 1, the temperature of the air chamber located on said end of the antenna 1 is increased to push the radiating portion 3 or grounding portion 4, and to make a plane having the weakest electromagnetic wave radiating in radiating pattern face the human body. The danger of the electromagnetic wave radiation that is harmful to the human body is minimized when the radiating portion is away from the user. It can enhance communication capability of the antenna and the operational safety of communication.

The radiating and grounding portions of the antenna in the present invention is overall moved for changing radiating areas of the radiating portion if one end of the antenna is subjected to environmental changes or changed temperature.

It is to be understood, however, that even though numerous characteristics of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna comprising:

a closed and insulating receiving housing;

a radiating portion received in the receiving housing and including a liquid metal;

a grounding portion received in the receiving housing and including a liquid metal;

a pair of wires respectively connected to the radiating portion and the grounding portion and extending out of the receiving housing; and two air chambers respectively located on ends of the radiating portion and the grounding portion, wherein the radiating portion further comprises a first piston located at one end of the liquid metal and a second piston located at the other end of the liquid metal.

2. The antenna as recited in claim 1, wherein at least one of said two pistons of the radiating portion is made of metal material.

3. The antenna as recited in claim 2, wherein the radiating portion further comprises an insulative portion enclosing the liquid metal, the first piston, and the second piston.

4. The antenna as recited in claim 2, wherein a feeder point is formed at a connecting point between one of the first and second pistons and the wire.

5. The antenna as recited in claim 1, wherein the grounding portion further comprises a first piston located at one end of the liquid metal and a second piston located at the other end of the liquid metal.

6. The antenna as recited in claim 5, wherein the grounding portion further comprises an insulative portion enclosing the liquid metal, the first piston, and the second piston.

7. The antenna as recited in claim 5, wherein at least one of said two pistons of the grounding portion is made of metal material, and a grounding point is formed at a connecting point between one of the two pistons and the wire.

8. The antenna as recited in claim 1, wherein the two wires penetrate through the liquid metals respectively.

9. The antenna as recited in claim 1, wherein the receiving housing extends with a bend.

10. An antenna comprising:

a closed and insulating receiving housing;

a pair of liquid metals received in the receiving housing;

three air chambers being full of air respectively, and being isolated by the two liquid metals;

a radiating portion including a wire connected to one of the liquid metals; and a grounding portion including another wire connected to the other liquid metal; wherein the two wires extend out of the receiving housing.

11. The antenna as recited in claim 10, wherein each of the radiating portion and the grounding portion further comprises a first piston located at one end of the liquid metal and a second piston located at the other end of the liquid metal.

12. The antenna as recited in claim 11, wherein at least one of the first and second pistons is made of metal material, and a feeder point is formed at a connecting point between the at least one piston and one of said two wires.

13. The antenna as recited in claim 11, wherein at least one of the first and second pistons is made of metal material, and a grounding point is formed at a connecting point between the at least one piston and one of said two wires.

14. A dipole antenna comprising:

a fluidic channel sealed at opposite grounding and radiating ends;

a radiating portion and a grounding portion received in and moveable along the fluidic channel with an air chamber therebetween to not only adjustably space said radiating portion and said grounding portion away from each other under different external pressures but also adjustably comply with common movement of said radiating portion and said grounding portion along and within the fluidic channel under said different external pressures wherein the radiating portion is closer to the radiating end than the grounding portion while the grounding portion is closer to the grounding end than the radiating portion;

the radiating portion including opposite first pistons commonly sandwiching a first metal liquid between said first pistons in a sealed manner;

the grounding portion including opposite second pistons commonly sandwiching a second metal liquid said second pistons in the sealed manner;

a radiating wire connected to the radiating portion and extending out of the fluidic channel around the radiating end; and a grounding wire connected to the grounding portion and extending out of the fluidic channel around the grounding end.

15. The dipole antenna as claimed in claim 14, wherein said different pressure result in temperature change.

16. The dipole antenna as claimed in claim 14, wherein said pressure absorber is an air chamber filled with air.

17. The dipole antenna as claimed in claim 14, wherein the fluidic channel is either curved or angled while being dimensioned to allow either the first piston or the second piston to pass.

18. The dipole antenna as claimed in claim 14, further including two pressure absorbers located between the radiating portion and the radiating end, and between the grounding portion and the grounding end, respectively.

19. The dipole antenna as claimed in claim 14, wherein the radiating wire and the grounding wire extend and move along the fluidic channel when the corresponding radiating portion and grounding portion moves along the fluidic channel.

* * * * *